US009541355B2

(12) United States Patent
Lin

(10) Patent No.: US 9,541,355 B2
(45) Date of Patent: Jan. 10, 2017

(54) METHOD OF MANUFACTURING DARTBOARD BY GRASS STEM

(71) Applicant: Juinung Lin, Taichung (TW)

(72) Inventor: Juinung Lin, Taichung (TW)

( * ) Notice: Subject to any disclaimer, the term of this patent is extended or adjusted under 35 U.S.C. 154(b) by 346 days.

(21) Appl. No.: 14/485,991

(22) Filed: Sep. 15, 2014

(65) Prior Publication Data

US 2015/0224754 A1 Aug. 13, 2015

(30) Foreign Application Priority Data

Feb. 7, 2014 (TW) ..... 103104014 A

(51) Int. Cl.
*F41J 3/00* (2006.01)

(52) U.S. Cl.
CPC ..... *F41J 3/0095* (2013.01); *Y10T 156/1074* (2015.01)

(58) Field of Classification Search
CPC ..... F41J 3/0095
See application file for complete search history.

(56) References Cited

U.S. PATENT DOCUMENTS 4,790,541 A * 12/1988 Lin ..... F41J 3/0095 273/408
5,972,467 A * 10/1999 Washo ..... B27J 1/00 144/333

* cited by examiner

*Primary Examiner* — Mark A Osele
*Assistant Examiner* — Christopher C Caillouet
(74) *Attorney, Agent, or Firm* — Rosenberg, Klein & Lee

(57) ABSTRACT

A method of manufacturing a dartboard by grass stem includes the steps of rolling grass stems and removing insect eggs, binding the grass stems into a bundle and then cutting the bundle into grass stem cakes, compressing the grass stem cakes into a target body of the dartboard, fixing a backplane of the target body coated with an adhesive, an insect repellent, and a preservative, and flattening a target surface before performing a printing process and a baking process, so as to prevent the dartboard from being damaged by insects and mildews.

11 Claims, 9 Drawing Sheets

METHOD OF MANUFACTURING DARTBOARD BY GRASS STEM

FIELD OF THE INVENTION

The present invention relates to a manufacturing method of dartboards, and more particularly to the method of manufacturing a dartboard by grass stems.

BACKGROUND OF THE INVENTION

Shooting darts is a general leisure activity as well as a professional competition, and the equipments for the sport of darts are nothing more than darts and a dartboard. The darts may be divided into darts with a steel dart head and darts with a plastic dart head according to the nature of the leisure activity and the professional competition, and the dartboard may be divided into a dartboard made of wood, linen, paper and special fiber.

In general, the dartboards used in an official competition are linen dartboards, and most of them are made of sisals with the properties of high durability and strength. However, the sisals are not accessible easily and mainly imported from other countries, and thus incurring a higher cost.

Although some of the dartboards are made of grass stems, the grass stems contain insect eggs. If the grass stems are not processed properly before using them to manufacture the dartboards, the insect eggs hidden in the dartboards will be hatched and the internal structure of the dartboard will be damaged by insects or mildews.

SUMMARY OF THE INVENTION

In view of the aforementioned drawback, it is a primary objective of the present invention to provide a method of manufacturing a dartboard by grass stem in order to overcome the problems of the dartboards made of grass stem that may be damaged by insects or mildews caused by the hatch of the insect eggs, and the dartboards made of grass stems features a sufficient structural strength, a low cost, and a high practicality.

To achieve the aforementioned objectives, the present invention provides a method of manufacturing a dartboard by grass stem comprises the following steps:

Roll a plurality of grass stems including branches and knots. Cut the grass stem in the lengthwise direction along a branch and a knot of the grass stem to remove insect eggs. Bind a plurality of cut grass stems into a bundle. Cut the grass stem along the widthwise direction to produce a plurality of grass stem cakes. Combine the plurality of grass stem cakes. Compress the grass stem cakes tightly in a transverse direction to form a target body of the dartboard. Fix the target body on a surface of a backplane coated with an adhesive, an insect repellent, and a preservative by a longitudinal compression method. Trim and flatten the predetermined target surface on the target body. Perform a printing process of the predetermined target surface, and heating and baking the target surface to remove moisture and vaporize the preservative and insect repellent to permeate into the target body. Set the frame border around the target body before/after heating and baking. Install a decorative object on the predetermined target surface to complete the manufacture of the dartboard.

The specific structure and practical functions of the present invention will be apparent with the description of the following preferred embodiment accompanied with the illustration of related drawings as follow.

DESCRIPTION OF THE PREFERRED EMBODIMENTS

With reference to FIGS. 1 to 9 for embodiments of the present invention, these embodiments are provided for the purpose of illustrating the present invention only, but not intended for limiting the scope of the invention.

Figure 1:
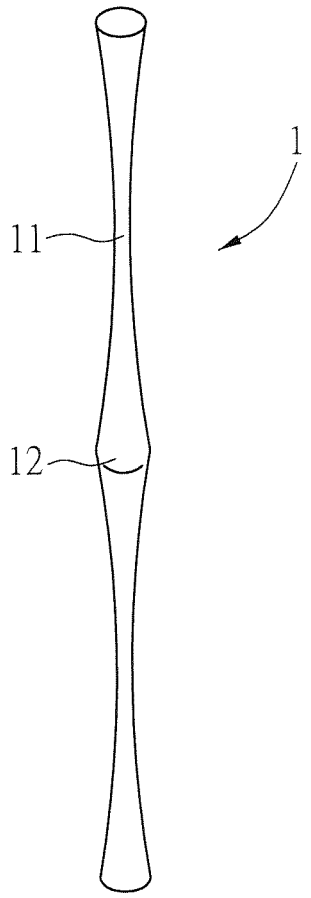
FIG. 1 is a schematic view of a grass stem of the present invention.

In a method of manufacturing a dartboard by grass stem in accordance with this preferred embodiment of the present invention, the grass stem 1 is straw as shown in FIG. 1, and the grass stem 1 includes a branch 11 and a knot 12. In other implementation modes, the grass stem may be rush grass or any other grass stem of similar nature.

The method manufacturing a dartboard by the grass stem 1 comprises the steps of: rolling and straightening the grass stems 1 including the branches 11 and knots 12; cutting open the grass stems 1 in a lengthwise direction along the branches 11 and knots 12 to remove insect eggs hidden in the branches 11 or knots 12 of the grass stems 1.

Figure 2:
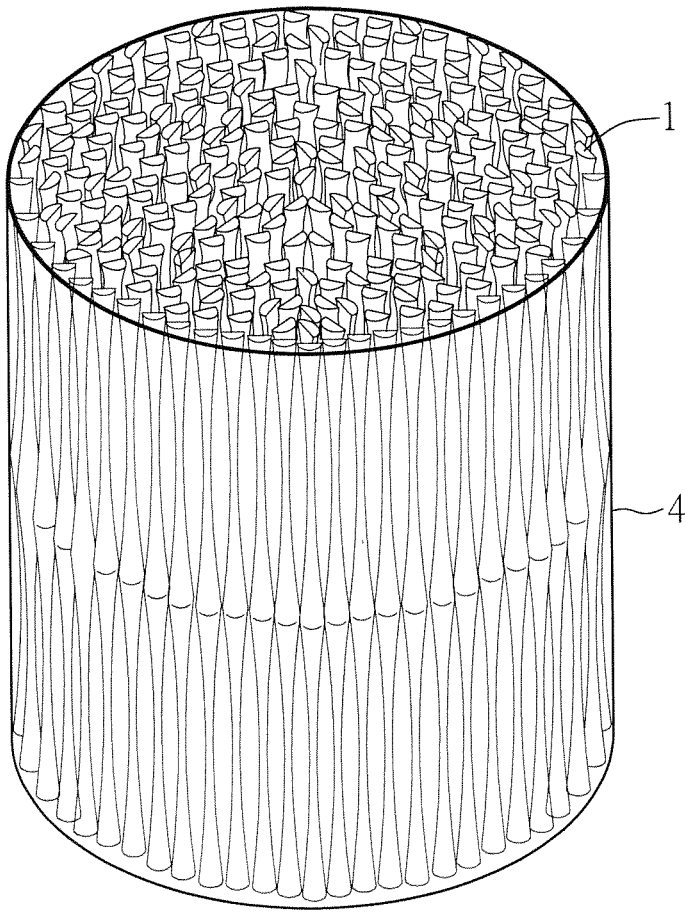
FIG. 2 is a schematic view of grass stems of the present invention after the grass stems are bound and fixed into a bundle.
Figure 3:
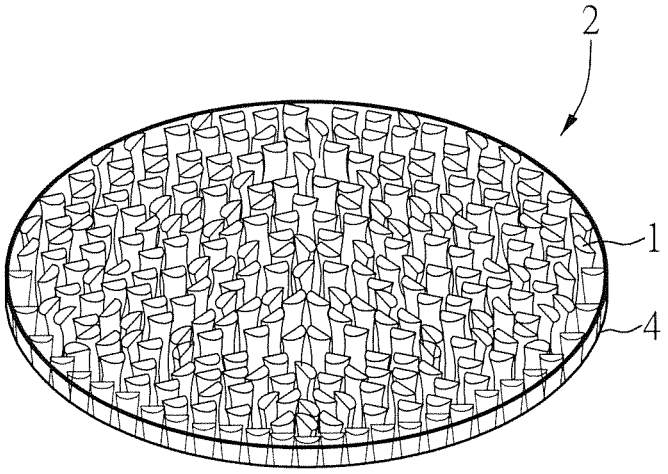
FIG. 3 is a schematic view of a grass stem cake of the present invention.
Figure 4:
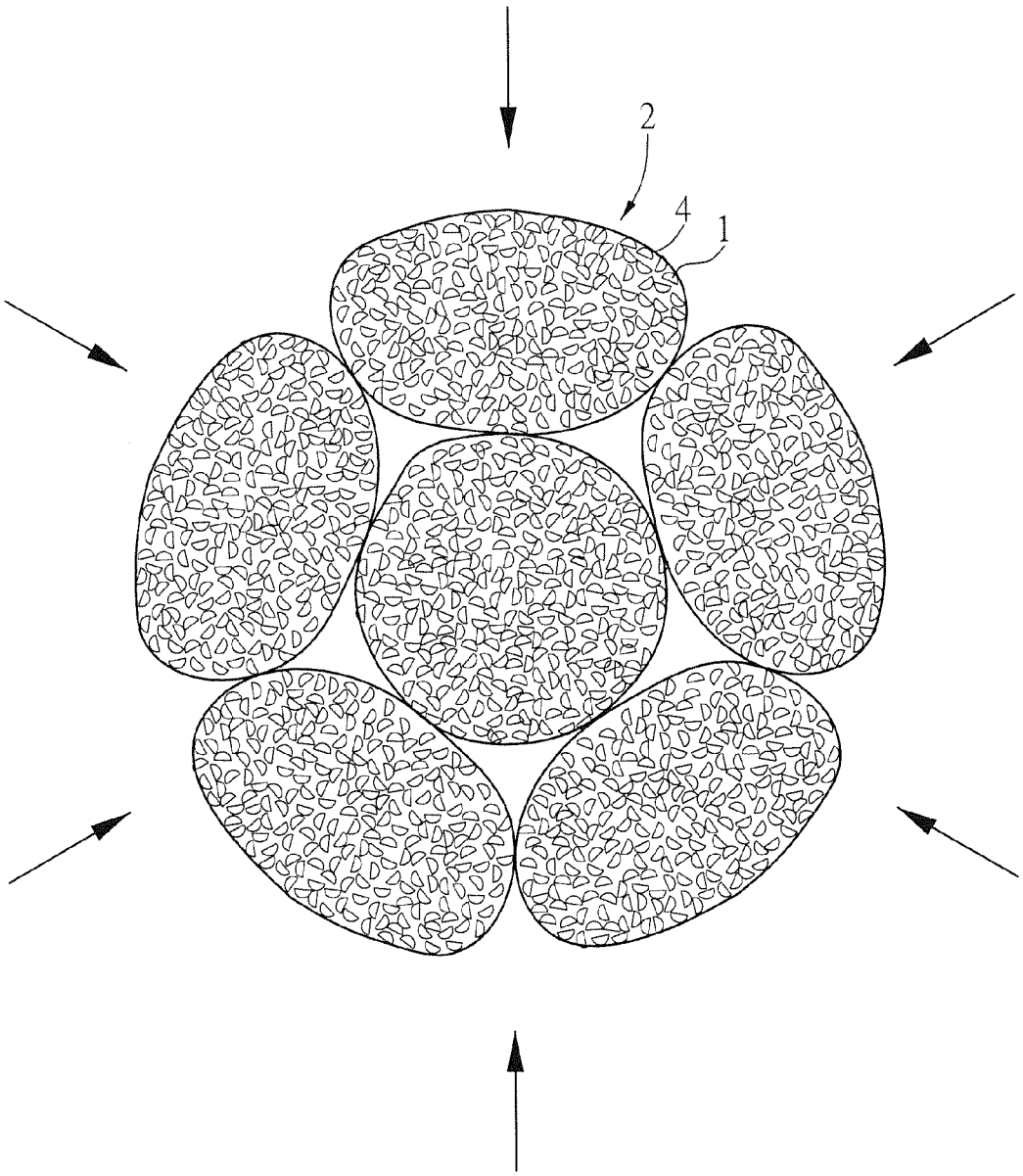
FIG. 4 is a schematic view of transversally pressing a plurality of grass stem cakes of the present invention.
Figure 5:
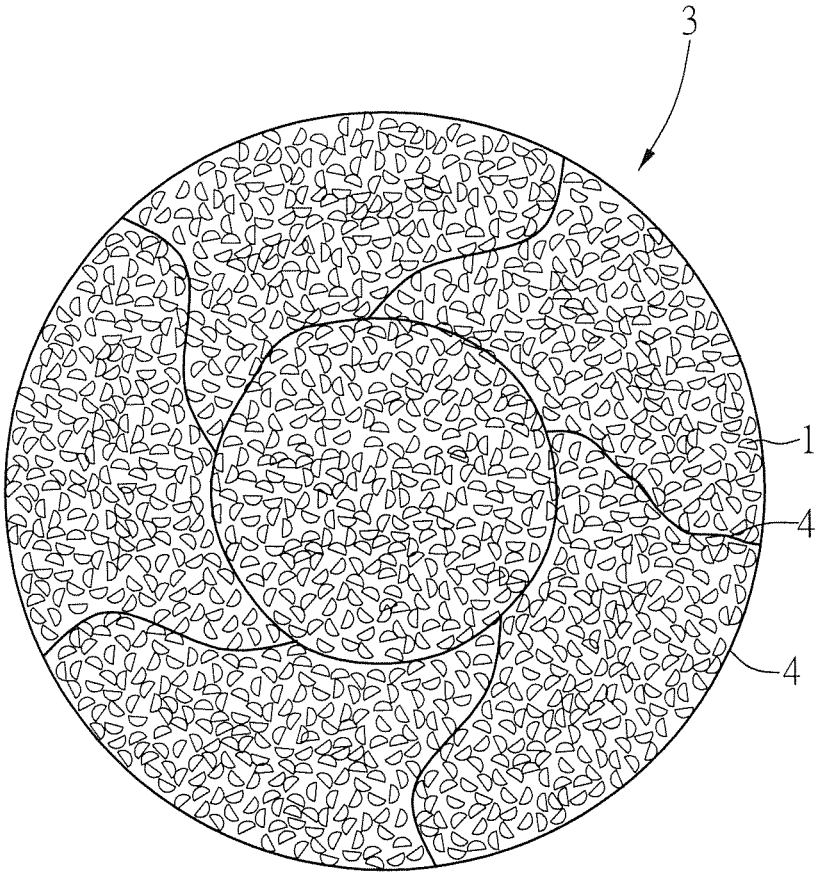
FIG. 5 is a schematic view of a plurality of grass stem cakes transversally pressed to form a target body in accordance with the present invention.

After the grass stems 1 are cut open, the grass stems 1 are bound and fixed to form a bundle as shown in FIG. 2, and the grass stems are cut in a widthwise direction to produce a plurality of grass stem cakes 2 as shown in FIG. 3, and then the grass stem cakes 2 are combined as shown in FIG. 4, and the grass stem cakes are compressed tightly in a transverse direction to form a target body 3 of the dartboard as shown in FIG. 5. In this embodiment, the cut grass stems 1 are bound and fixed by tape 4 to form a bundle.

Figure 6:
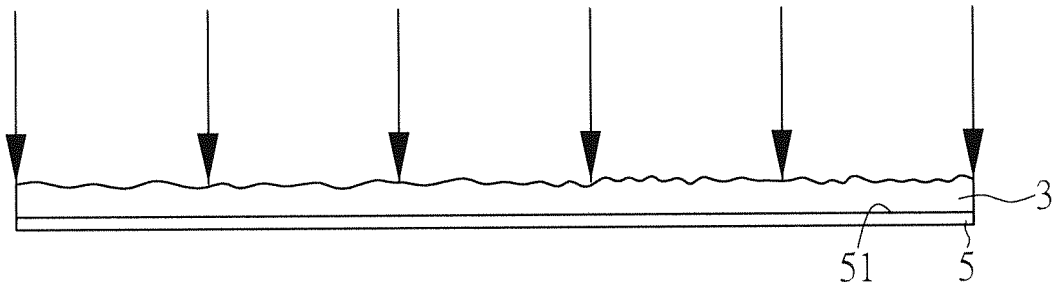
FIG. 6 is a schematic view of a target body compressed longitudinally to fix onto a backplane in accordance with the present invention.
Figure 7:
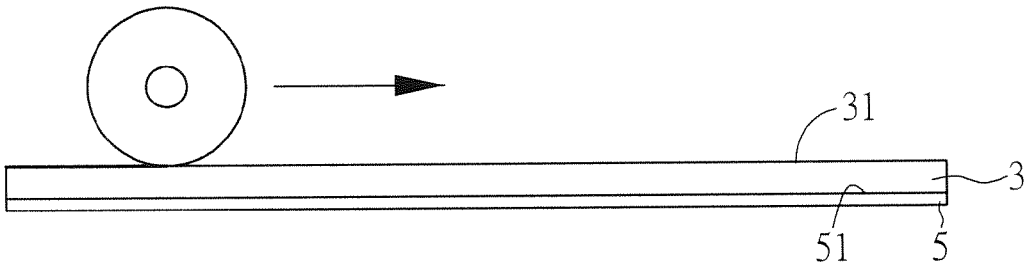
FIG. 7 is a schematic view of flattening a target surface of a target body to perform a printing process in accordance with the present invention.

In FIG. 6, the target body 3 on a surface 51 of a backplane 5 is fixed by a longitudinal compression method, and the surface 51 is coated with an adhesive, an insect repellent and a preservative. After the target body 3 is fixed to the surface 51 of the backplane 5, the predetermined target surface 31 on the target body 3 is trimmed and flattened as shown in FIG. 7, and then a printing process of the predetermined target surface 31 is performed. The printing process refers to setting the color of the target surface 31. In this embodiment, the insect repellent is sulfur and the adhesive is white glue.

Figure 8:
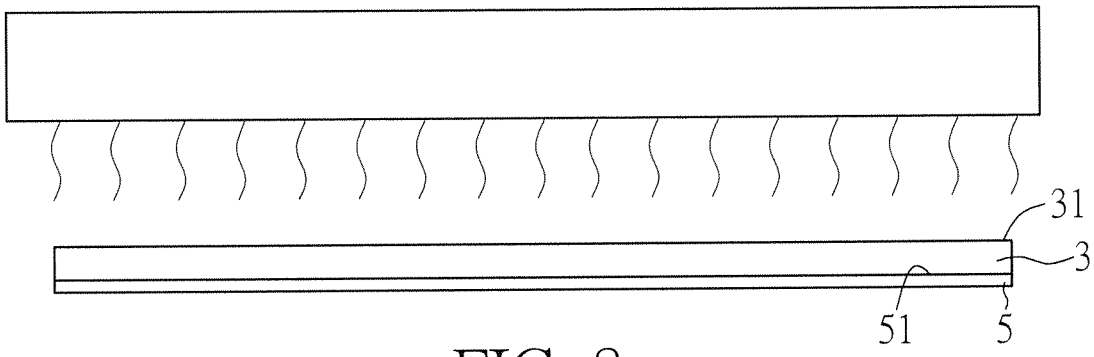
FIG. 8 is a schematic view of heating and baking a target surface after performing a printing process in accordance with the present invention.
Figure 9:
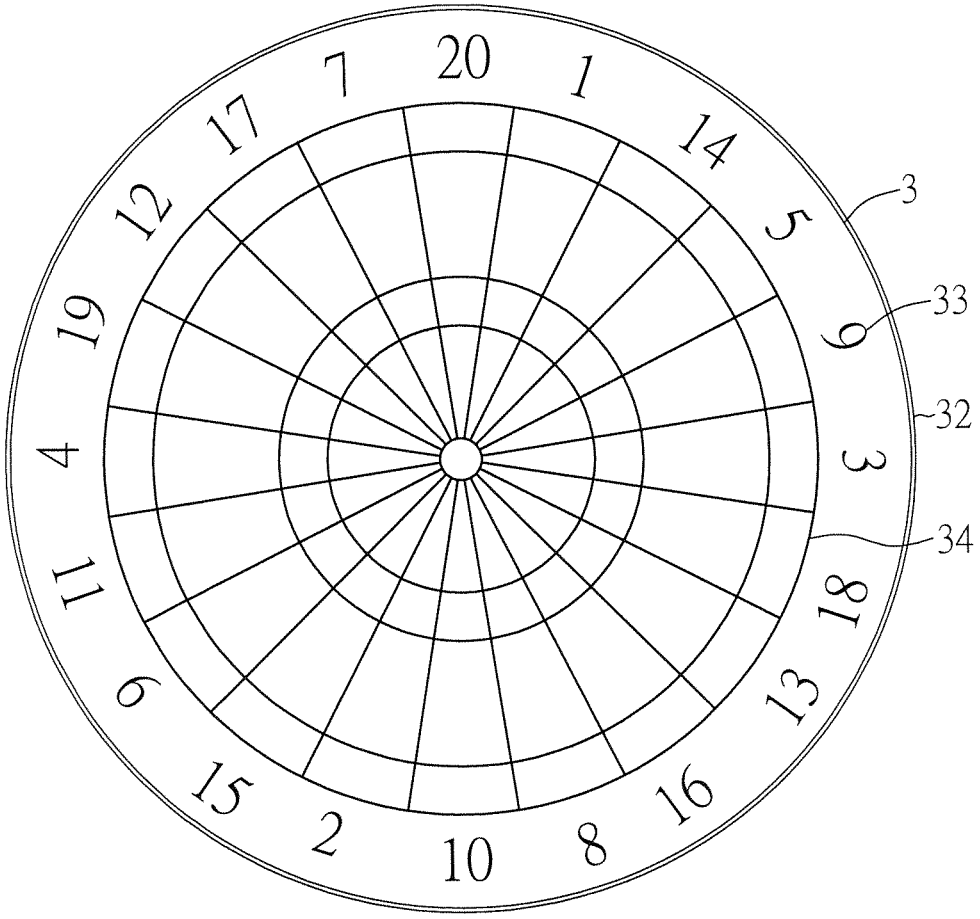
FIG. 9 is a schematic view of a manufactured dartboard of the present invention.

After the printing process of the target surface 31 is completed, heating and baking are preformed to remove moisture and vaporize the preservative and the insect repellent to permeate into the target body 3 as shown in FIG. 8. In this embodiment, the frame border 32 is mounted around the target body 3 and a decorative object is installed to the predetermined target surface 31 after heating and baking, so as to complete the manufacture of the dartboard as shown in FIG. 9, wherein the decorative object refers to a number 33 and a separating strip 34 on the target surface 31.

In summation of the description above, the present invention has the following advantages: Before the grass stems 1 are bound and fixed to form a bundle, the grass stems 1 are cut open in a direction along the branches 11 and knots 12 of the grass stems 1 to peel off or remove insect eggs hidden in the branches 11 or knots 12 from the grass stems 1. After the target body 3 is formed, the target body 3 is heated and baked to produce a drying effect in order to remove moisture in the target body 3 and vaporize the insect repellent and preservative in high temperature to permeate into the target body 3, so as to further protect the target body 3 and provide the pest control and preservation effects to the target body 3. Therefore, the dartboards can be manufactured with a lower cost than that made of sisals. In the manufacturing process, the grass stems 1 are cut, and the surface 51 is added with the insect repellent and preservative, and the target body 3 is heated and baked to overcome the issue of having insect eggs hidden in the grass stems and prevent the target body 3 from being damaged by insects and mildews. As a result, the structural strength of the target body 3 and the durability of these dartboards are as good as those of the sisal dartboards. Therefore, the present invention has the features of a low cost and a high practicality.

Of course, there are numerous embodiments of the present invention, and some just have minor modification on the knots. Compared with the first preferred embodiment, the second preferred embodiment is different from the first preferred embodiment as described below. In the first preferred embodiment, the grass stem 1 is cut in a widthwise direction to produce a plurality of grass stem cakes 2, and then the grass stem cakes 2 are combined and compressed tightly in a transverse direction to form a target body 3 of the dartboard. On the other hand, in the second embodiment, the grass stem 1 is cut in a widthwise direction to produce a plurality of grass stem cakes 2, and an insect repellent is added into the grass stem cake 2 before performing a first-time baking, and then the grass stem cakes 2 processed by the first-time baking are combined and compressed tightly in a transverse direction to form a target body 3 of the dartboard. In the first preferred embodiment, heating and baking take place after the printing process of the target surface 31 is completed. In the second preferred embodiment, the aforementioned process is a second-time baking process.

This preferred embodiment not just achieves the same effect of the first preferred embodiment, only, but also provides a good pest control effect by adding an insect repellent after the grass stem cakes 2 are cut, so that the insect repellent is filled all over the grass stem cakes 2 (including the areas such as the gaps formed when the grass stem cakes 2 are not compressed tightly), and the first-time baking also takes place if the grass stem cakes 2 are not compressed tightly, wherein the first-time baking takes place at a temperature of 80° to 150° for 1.5 to 2.5 hours, so that the first-time baking achieves the effect of keeping the grass stem cakes 2 dry and prevent moisture from remaining in the grass stem cakes 2 or causing the issue of mildews.

The invention claimed is:

1. A method of manufacturing a dartboard by grass stem, comprising the steps of:

rolling and straightening a plurality of grass stems including branches and knots;

cutting open the grass stems in a lengthwise direction along the branches and knots to remove insect eggs;

binding the cut grass stems into a bundle;

cutting the grass stems in a widthwise direction to produce a plurality of grass stem cakes;

combining the plurality of grass stem cakes and pressing the grass stem cakes tightly to form a target body of the dartboard;

fixing the target body on a surface of a backplane coated with an adhesive, an insect repellent and a preservative by a longitudinal compression method;

trimming and flattening a predetermined target surface of the target body;

performing a printing process of the predetermined target surface and heating and baking the predetermined target surface to remove moisture and vaporize the preservative and insect repellent to permeate into the target body;

mounting a frame border around the target body before or after heating and baking; and installing a decorative object onto the predetermined target surface to complete manufacturing the dartboard.

2. The method of manufacturing a dartboard by grass stem according to claim 1, wherein the cut grass sterns are bounded and fixed by a tape to form a bundle.

3. The method of manufacturing a dartboard by grass stem according to claim 1, wherein the insect repellent is sulfur and the adhesive is white glue.

4. The method of manufacturing a dartboard by grass stem according to claim 1, wherein the grass stem is straw.

5. The method of manufacturing a dartboard by grass stem according to claim 1, wherein the grass stem is rush grass.

6. A method of manufacturing a dartboard by grass stem, comprising the steps of:

rolling and straightening a plurality of grass stems including branches and knots;

cutting the grass stem in a lengthwise direction along branches and knots to remove insect eggs;

binding and fixing the plurality of cut grass stems to produce a bundle;

cutting the grass stems in a widthwise direction to produce a plurality of grass stem cakes;

adding an insect repellent into the grass stem cake before performing a first-time baking process;

combining the plurality of grass stem cakes processed by the first-time baking process;

pressing the grass stem cakes tightly in a transverse direction to form a target body of the dartboard;

fixing the target body on a surface of a backplane coated with an adhesive, an insect repellent and a preservative by a longitudinal compression method;

trimming and flattening a predetermined target surface of the target body;

performing a printing process of the predetermined target surface and heating and performing a second-time baking process of the predetermined target surface to remove moisture and vaporize the preservative and insect repellent to permeate into the target body;

mounting a frame border around the target body before or after heating and baking; and installing a decorative object onto the predetermined target surface to complete manufacturing the dartboard.

7. The method of manufacturing a dartboard by grass stem according to claim 6, wherein the cut grass stems are bounded and fixed by a tape to form a bundle.

8. The method of manufacturing a dartboard by grass stem according to claim 6, wherein the insect repellent is sulfur and the adhesive is white glue.

9. The method of manufacturing a dartboard by grass stem according to claim 6, wherein the grass stem is straw.

10. The method of manufacturing a dartboard by grass stem according to claim 6, wherein the grass stem is rush grass.

11. The method of manufacturing a dartboard by grass stem according to claim 6, wherein the first-time baking takes place at a temperature of 80° to 150° for 1.5 to 2.5 hours.

* * * * *